US010295252B2

(12) United States Patent
Howard

(10) Patent No.: US 10,295,252 B2
(45) Date of Patent: May 21, 2019

(54) SYSTEM AND METHOD FOR PROVIDING REFRIGERATION TO A CRYOGENIC SEPARATION UNIT

(71) Applicant: Henry E. Howard, Grand Island, NY (US)

(72) Inventor: Henry E. Howard, Grand Island, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 607 days.

(21) Appl. No.: 14/923,836

(22) Filed: Oct. 27, 2015

(65) Prior Publication Data

US 2017/0115054 A1 Apr. 27, 2017

(51) Int. Cl.
*F25J 3/04* (2006.01)

(52) U.S. Cl.
CPC ..... *F25J 3/04412* (2013.01); *F25J 3/0443* (2013.01); *F25J 3/04175* (2013.01); *F25J 3/04296* (2013.01); *F25J 3/04345* (2013.01); *F25J 3/04393* (2013.01); *F25J 2205/04* (2013.01); *F25J 2245/50* (2013.01)

(58) Field of Classification Search
CPC ..... F25J 3/04339–04345; F25J 3/04393; F25J 2245/40
See application file for complete search history.

(56) References Cited

U.S. PATENT DOCUMENTS

| | | | |
|---|---|---|---|
| 4,715,873 A | 12/1987 | Auvil et al. | |
| 5,157,926 A | 10/1992 | Guilleminot | |
| 5,758,515 A | 6/1998 | Howard | |
| 2012/0131951 A1 | 5/2012 | Myobatake et al. | |
| 2016/0003528 A1* | 1/2016 | Pages | F25J 1/0022 62/613 |

FOREIGN PATENT DOCUMENTS

| | | |
|---|---|---|
| EP | 0 661 505 A1 | 7/1995 |
| EP | 1 329 680 A1 | 7/2003 |
| EP | 3 034 974 A1 | 6/2016 |

* cited by examiner

*Primary Examiner* — Tareq Alosh
(74) *Attorney, Agent, or Firm* — Robert J. Hampsch

(57) ABSTRACT

A system and method for providing refrigeration to a cryogenic separation unit is provided. The disclosed system and associated methods employ both a warm recycle turbine arrangement and cold turbine arrangement to provide the refrigeration required to produce a large amount of liquid products, such as liquid oxygen, liquid nitrogen and liquid argon when used in a cryogenic air separation unit.

8 Claims, 1 Drawing Sheet

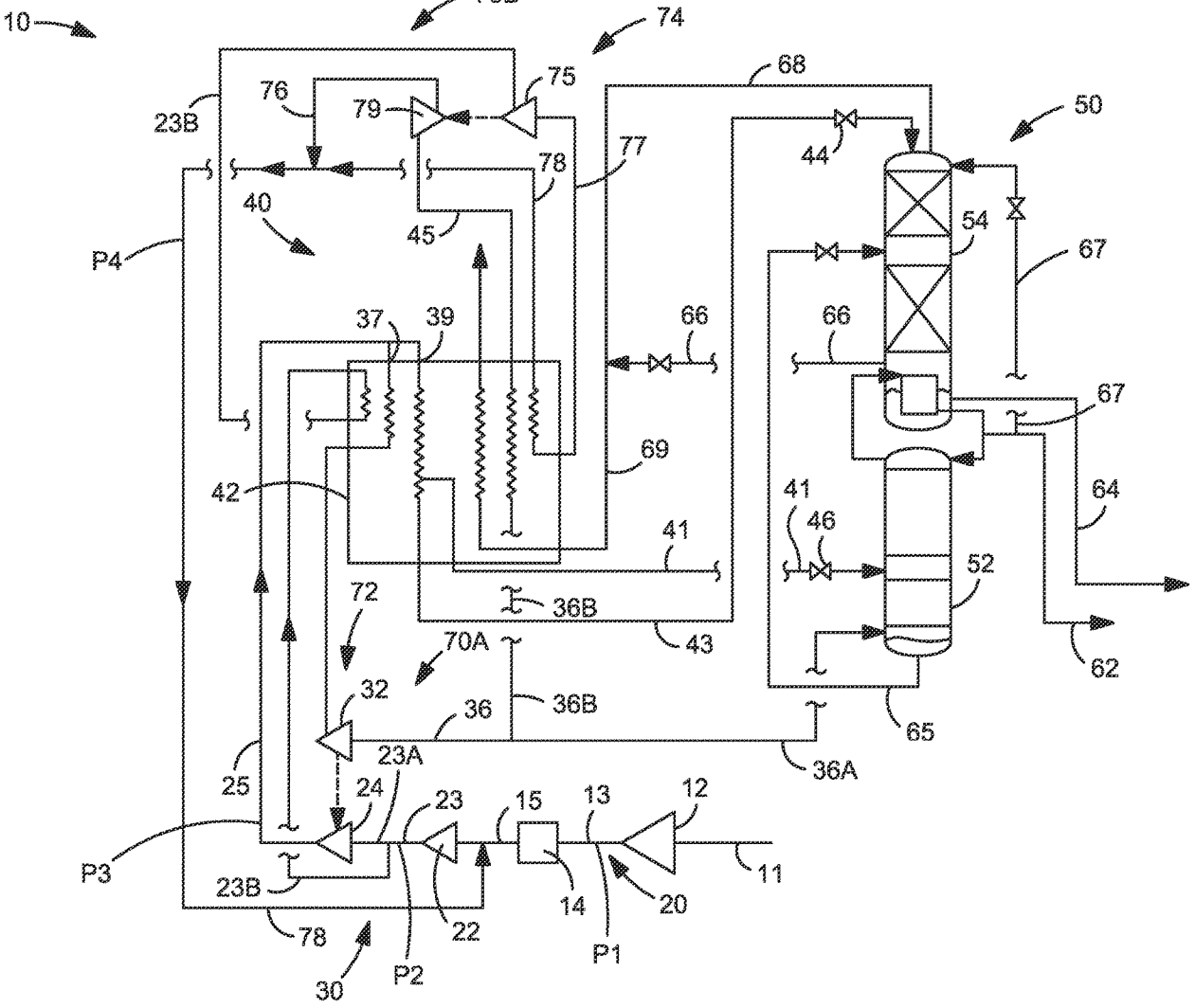
10
11
12
13
14
15
20
22
23
23A
23B
24
25
30
32
36
36A
36B
37
39
40
41
42
43
44
45
46
50
52
54
62
64
65
66
67
68
69
70A
70B
72
74
75
76
77
78
79
P1
P2
P3
P4

SYSTEM AND METHOD FOR PROVIDING REFRIGERATION TO A CRYOGENIC SEPARATION UNIT

TECHNICAL FIELD

The present invention relates to a system and method for providing refrigeration to a cryogenic separation unit, and more specifically, to a system and method which incorporates both warm and cold turbine arrangements that are configured to provide the refrigeration required to enable increased liquid product make.

BACKGROUND

Cryogenic air separation is a very energy intensive process due to the need to generate very low temperature refrigeration and separate feed constituents of low relative volatility. The cryogenic air separation process is further complicated when it is integrated with a liquefaction process to recover substantial flows of liquid products from the air separation unit. In cryogenic air separation units designed to produce a large amount of liquid products, such as liquid oxygen, liquid nitrogen and liquid argon, a large amount of refrigeration must be provided, typically through the use of multi-turbine process arrangements.

A broad set of refrigeration configurations are designed to expand the feed air. Feed air expansion arrangements are often referred to as air pre-expansion configurations. High pressure feed air may be first cooled and then expanded in whole or in part to any one of the nitrogen rectification sections of the column system. In many instances, the demand for liquid products eclipses the potential production from air pre-expansion. In such circumstances, a warm turbine may be configured to expand air or another fluid for purposes of warm end fore-cooling. Such arrangements can be configured as open or semi-closed recycle systems. Such configurations impart refrigeration to the cryogenic air distillation column system via indirect heat exchange with the pre-purified, compressed feed air in the primary heat exchanger or in an auxiliary heat exchanger.

In the air pre-expansion arrangement, a portion of the pre-purified, compressed feed air is often further compressed in a boosted air compressor, partially cooled in the primary heat exchanger, and then all or a portion of this further compressed, partially cooled stream is diverted to a turbine. The expanded gas stream or exhaust stream is then directed to the higher pressure column of a dual pressure cryogenic air distillation column system. In some air pre-expansion arrangements, a portion of the compressed and purified air is diverted to a turbine without further compression in a booster air compressor, Alternatively, a portion of the pre-purified, compressed feed air is partially cooled in the primary heat exchanger; a portion of this partially cooled stream is diverted to a second turbo-expander. The expanded gas stream or exhaust stream may be optionally cooled via direct or indirect heat exchange and directed to into a lower pressure column in the a thermally linked dual pressure distillation column system such as a two-column or three column distillation column system of a cryogenic air separation unit. The turbo-expansion of various column feed streams serves to refrigerate the distillation process. The work of expansion provides the refrigeration necessary to offset warm end temperature loss, process heat leak and to generate liquid products. In general, when column feed streams are expanded prior to column entry the refrigeration generated is subsequently recouped by the warming of the various product streams. The indirect heat exchange of warming column products provides then necessary cooling of the various feed air streams prior to column entry.

In order to increase the fraction of liquefied products extracted from the column system to above approximately 40% of the incoming feed air, refrigeration must be imparted to the cold end of the primary heat exchanger. Prior art processes have addressed this need by recycling a portion of the cold turbo-expanded gas stream through the primary heat exchanger.

Prior art cryogenic air separation processes have dealt with this issue by further turbo-expand the portion of air recycled to the cold turbine in an air separation unit to pressures at or near ambient pressure, as disclosed in U.S. Pat. No. 5,157,926. Such an approach, however suffers due to increased costs required to handle the near ambient pressure stream in the primary heat exchanger. In addition, the warm expansion turbine is constrained to operate between the pressure of the lower column and near ambient pressure. In addition such processes substantially increase the pre-purification demands on the process.

Accordingly, there is a need to reduce the costs associated with high liquid make cryogenic air separation units while maintaining high thermodynamic efficiency of the integrated cryogenic air separation and liquefaction system. Such solutions must also maintain the simplicity, reliability and relatively low cost of the rotating machinery used in the cold and warm turbines as well as the associated booster compression.

SUMMARY OF THE INVENTION

The present invention may be characterized as a method for air separation and liquefaction, the method comprising the steps of: (a) compressing at least a portion of a feed stream, such as air, in a multi-stage main feed compression system to a first pressure; (b) purifying the compressed feed stream to remove high boiling contaminants and other impurities; (c) further compressing at least a portion of the purified, compressed feed stream in a booster compression system to a second pressure; (d) still further compressing at least a portion of the further compressed feed stream at the second pressure in the booster compression system to a third pressure; (e) cooling a first portion of the further compressed feed stream at the third pressure in a primary heat exchanger and expanding the cooled first portion of the feed stream in a first turbine to a pressure suitable for introduction into the cryogenic separation unit; (f) cooling and substantially condensing a second portion of the further compressed feed stream at the third pressure and feeding the condensed second portion to a distillation column system of the cryogenic separation unit; (g) directing a first portion of the exhaust stream from the first turbine to a distillation column system of the cryogenic separation unit where it is separated to produce at least one liquefied product, such as liquid oxygen, liquid nitrogen, liquid argon or combinations thereof; (h) warming a second portion of the exhaust stream from the first turbine and compressing the warmed second portion of the exhaust stream from the first turbine in a recycle compression system to produce a recycle stream at a recycle pressure between the first pressure and the second pressure; (i) recycling the recycle stream to the purified, compressed feed stream; (j) diverting a portion of the purified, compressed feed stream between the first pressure and the third pressure to a second turbine and expanding the diverted portion of the purified, compressed feed stream to a pressure between the first pressure and the second pressure; and (k) warming the exhaust stream from the second turbine in the primary heat exchanger and recycling the warmed exhaust stream from the second turbine to the purified, compressed feed stream. Preferably, the pressure of the warmed exhaust stream from the second turbine is roughly the same as the recycle pressure.

The present invention may also be characterized as a cryogenic separation unit comprising: (i) a multi-stage main feed compression system configured for compressing at least a portion of a feed stream to a first pressure; (ii) a pre-purifier unit disposed downstream of the main feed compression system and configured for purifying the compressed feed stream to remove impurities; (iii) a booster compression system disposed downstream of the pre-purifier unit and configured for further compressing the purified, compressed feed stream to a second pressure and then further compressing a portion of the purified, compressed feed stream at the second pressure to a third pressure; (iv) a primary heat exchanger configured to receive a first portion and a second portion of the compressed, purified feed stream at the third pressure, partially cool the first portion of the compressed, purified feed stream at the third pressure, and substantially condense the second portion of the compressed, purified feed stream at the third pressure to temperatures suitable for rectification in a distillation column system; (v) a first turbine arrangement configured to receive the partially cooled first portion of the compressed, purified feed stream at the third pressure, expand such first portion to provide refrigeration, wherein a portion of the expanded stream is directed to the distillation column system where it is separated to produce at least one liquefied product and wherein another portion of the expanded stream is directed to the primary heat exchanger where it is warmed; (vi) a recycle compression circuit configured to receive another portion of the expanded stream from the first turbine arrangement, warm the another portion of the expanded stream in the primary heat exchanger, further compress the warmed expanded stream in a recycle compressor to produce a recycle stream at a recycle pressure between the first pressure and the second pressure, wherein the recycle stream is recycled to a location upstream of the boosted compression system; (vii) a second turbine arrangement configured to receive a portion of the purified, compressed feed stream at the second pressure and expand such portion to provide refrigeration, wherein the expanded stream from the second turbine arrangement is warmed in the primary heat exchanger and recycled to a location upstream of the boosted compression system; and (viii) a warm turbine recycle circuit configured to receive the expanded stream from the second turbine arrangement, warm the expanded stream in the primary heat exchanger, and recycle the warmed expanded stream from the second turbine arrangement to a location upstream of the boosted compression system.

In the present system and method, the first turbine or first turbine arrangement is preferably configured as a lower column turbine which directs a portion of the exhaust stream to the higher pressure column of the distillation column system. The first turbine and/or the second turbine may be further configured or arranged such that the shaft work of expansion from the first turbine and/or the second turbine drives one or more stages of compression in the booster compression system and/or the recycle compression system. Optionally, where the exhaust stream of the first turbine is a two-phase stream, a phase separator may be employed downstream of the first turbine to separate the phases and direct the separated streams to the distillation column system.

BRIEF DESCRIPTION OF THE DRAWING

While the specification concludes with claims specifically pointing out the subject matter that Applicant regards as the invention, it is believed that the invention will be better understood when taken in connection with the accompanying drawing in which FIG. 1 is a schematic illustration of an embodiment of an integrated cryogenic separation and liquefaction system outlining a process or method for cryogenic separation and liquefaction in accordance with the present invention.

DETAILED DESCRIPTION

Turning now to FIG. 1, there is shown a simplified illustration of the present cryogenic separation system 10 and process. In a broad sense, the present system and method comprises: a multi-stage main feed compression train 20; one or more booster compression circuits 30, a main or primary heat exchange section 40; two or more turbine based refrigeration circuits 70A and 70B, and a distillation column system 50.

In the main feed compression train 20 shown in FIG. 1, the incoming feed air 11 is compressed in a multi-stage main air compressor arrangement 12 to a pressure P1 generally in the range of about 130 psia to about 190 psia. The compressed air feed 13 is then purified in a pre-purification unit 14 to remove high boiling contaminants from the incoming feed air. Such a pre-purification unit 14 typically has beds of adsorbents to adsorb such contaminants as water vapor, carbon dioxide, and hydrocarbons.

As described in more detail below, the compressed, purified feed air stream 15 is separated into oxygen-rich, nitrogen-rich, and argon-rich fractions in a plurality of distillation columns including a higher pressure column 52, a lower pressure column 54, and optionally, argon column (not shown). Prior to such distillation however, the compressed, pre-purified feed air stream 15 is split into a plurality of feed air streams that are cooled to temperatures suitable for rectification. Cooling the compressed, purified feed air streams is accomplished by way of indirect heat exchanger with the warming column system 50 streams which include the oxygen, nitrogen and/or argon waste. Refrigeration is generated by the cold and warm turbine arrangements disposed within the turbine based refrigeration circuits.

In the present embodiment, the compressed, pre-purified air stream 15 is further compressed in a recycle air compressor (RAC) 22 to a pressure P2 in range of about 450 psia to about 550 psia. A first portion of this warm, further compressed, pre-purified air 23A is still further compressed by way of a boosted air compressor 24 preferably powered by way of the shaft work of expansion from a first turbo-expander 32 to a third pressure P3. As illustrated, the first turbo-expander 32 providing the shaft work is preferably one of the turbo-expanders associated with the cold-turbine arrangement 72, and preferably a lower column turbine (LCT). The resulting pressure, P3, of this first portion of compressed, pre-purified feed air 23A is preferably in the range of about 650 psia to about 850 psia. A second portion of the warm, further compressed, pre-purified air 23B is diverted to the refrigeration circuits 70B, and more particularly to the warm recycle turbine (WRT) arrangement 74 as a warm recycle air stream 23B, described below.

The first portion of compressed, pre-purified feed air 23A is high pressure feed air stream that is further split into a first subportion high pressure feed air stream 37 and a second subportion high pressure feed air stream 39. The first subportion high pressure feed air stream 37 is partially cooled in the primary heat exchanger 42 and expanded in the first turbo-expander 32 associated with the LCT cold turbine arrangement 72, while the second subportion high pressure feed air stream 39 is liquefied in the primary heat exchanger 42 and fed to the distillation column system 50. As illustrated, part of the second subportion high pressure feed air stream 39 is liquefied in the primary heat exchanger 42 and the resulting liquid air stream 41 is expanded in valve 46 and introduced at an intermediate location of the higher pressure column 52 while another part of the second subportion high pressure feed air stream 39 is liquefied in the primary heat exchanger 42 and the resulting liquid air stream 43 is expanded in valve 44 and introduced as liquid air to the lower pressure column 54. The splitting of the high pressure feed air stream 23A may be accomplished either upstream of the primary heat exchanger 42 or within the primary heat exchanger at selected locations to achieve the desired cooling profiles of the different portions and subportions of the high pressure feed air stream.

Part of the exhaust stream 36A from the first turbo-expander 32 of the LCT based cold turbine arrangement 72 is fed directly to the distillation column system 50, and more preferably to the higher pressure column 52 while another part of the exhaust stream 36B from the first turbo-expander 32 of the LCT based cold turbine arrangement 72 is diverted to the primary heat exchanger 42 where it is warmed to near ambient temperatures and the resulting LCT recycle stream 45 is compressed in the WRT booster compressor 79. Stream 36A may be optionally subcooled against a waste nitrogen stream and/or phase separated prior to column entry. The compressed LCT recycle stream 76 is then combined with the warmed WRT exhaust stream 78 and recycled back to the compressed and purified feed air stream 15, preferably at a location upstream of the RAC 22. One of the key aspects or features of the present system and method is this recompression of the LCT recycle stream 45 to a pressure, P4, that is not less than the pressure P1 of the compressed air feed exiting the multi-stage main feed air compressor 12 or pre-purification unit 14.

In the illustrated embodiment, between about 50% and 70%, and more preferably about 60% of the exhaust stream 36 from the first turbo-expander 32 of the LCT based cold-turbine arrangement 72 is recycled back through the primary heat exchanger 42 while the remaining 30% to 50% of the exhaust stream 36 from the first turbo-expander 32 of the LCT based cold turbine arrangement 72 is fed to the distillation column system 50. In a preferred mode of operation, the remaining exhaust stream 36A is fed directly to the higher pressure column 52. In cases where the exhaust stream is a two phase stream, the exhaust stream may also be directed to a phase separator either upstream or downstream of the LCT exhaust split to further condition the stream prior to introduction into the distillation column system.

Within the illustrated distillation column system 50, the various feed air streams in both gaseous and liquid forms are separated in manners well known to those persons skilled in the art into various product streams, kettle streams, and waste streams, including a liquid nitrogen product stream 62 and a liquid oxygen product stream 64, which are preferably directed to suitable storage vessels (not shown). A portion of the liquid nitrogen stream 67 may be used to reflux the lower pressure column 54. Likewise, a portion of the kettle stream 65 may be re-introduced to the lower pressure column 54.

The waste streams comprised of excess gaseous oxygen 66 and lower pressure column overhead gaseous nitrogen 68 are preferably returned to the primary heat exchanger 42 where they are warmed to temperatures at or near ambient temperature and indirectly cooling the high pressure incoming air feed streams. Optionally, the gaseous nitrogen overhead stream 68 may be used as a source of subcooling streams entering the distillation column system 50. Optionally, the gaseous oxygen stream 66 and gaseous nitrogen overhead stream 68 may be combined into a single waste stream 69 prior to warming in the primary heat exchanger 42.

Key features of the present system and method are derived from the management of the various warming recycle streams obtained from both the cold and warm turbines. In the illustrated embodiment, a warm recycle air stream 23B is extracted from the discharge of the RAC 23 and directed via a warm recycle circuit to the primary heat exchanger 42, partially cooled in the primary heat exchanger 42 and expanded in a second turbo-expander 75 of the warm recycle turbine (WRT) arrangement 74 to a pressure not less than the pressure of the compressed air feed exiting the multi-stage main feed air compressor 12 or pre-purification unit 14. While the stream 23B is shown as being partially cooled in the primary heat exchanger, the stream 23B could alternatively be cooled by other cooling means such as a refrigeration system. The exhaust 77 from the second turbo-expander 75 is then warmed in the primary heat exchanger 42 thereby producing WRT recycle stream 78 which is returned or recycled back to the compressed, purified feed air stream 15, preferably at a location upstream of the RAC 22.

While the present invention has been described with reference to a preferred embodiment and operating method associated therewith, it should be understood that numerous additions, changes and omissions to the disclosed system and method can be made without departing from the spirit and scope of the present invention as set forth in the appended claims.

For example, the warm recycle air stream 23B may be extracted or diverted from the discharge of the LCT booster compressor 24, partially cooled in the primary heat exchanger 42 and subsequently expanded in the second turbo-expander 75 of the warm recycle turbine (WRT) arrangement 74 to generate refrigeration.

Also, the warm booster compressor discharge pressure and the WRT exhaust pressure are preferably equivalent so that the streams 76 and 78 may be combined prior to recycling the combined stream 78 to the purified, compressed feed air stream 15. However, in arrangements where the warm booster compressor discharge pressure and the WRT exhaust pressure differ, the LCT recycle stream 76 and the warmed WRT exhaust stream 78 may be returned or recycled separately to selected locations in the purified, compressed feed streams 15 or 23.

What is claimed is:

1. A method for providing refrigeration to a cryogenic separation unit, the cryogenic separation unit having a distillation column system with a lower pressure column and a higher pressure column, the method comprising the steps of:

compressing at least a portion of a feed stream in a multi-stage main feed compression system to a first pressure;

purifying the compressed feed stream to remove high boiling contaminants and other impurities;

further compressing at least a portion of the purified, compressed feed stream in a booster compression system to a second pressure;

still further compressing at least a portion of the further compressed feed stream at the second pressure in the booster compression system to a third pressure, wherein the third pressure is greater than the second pressure;

cooling a first portion of the still further compressed feed stream at the third pressure in a primary heat exchanger and expanding the cooled first portion of the feed stream at the third pressure in a first turbine to a pressure suitable for introduction into the higher pressure column;

cooling and condensing a second portion of the still further compressed feed stream at the third pressure in the primary heat exchanger and feeding the condensed second portion from the primary heat exchanger to the lower pressure column of the distillation column system;

directing a first portion of the exhaust stream from the first turbine to the higher pressure column of the distillation column system, wherein the first portion of the exhaust stream from the first turbine comprises between 30% and 50% of the exhaust stream from the first turbine;

warming a second portion of the exhaust stream from the first turbine which comprises between 50% and 70% of the exhaust stream from the first turbine and compressing the warmed second portion of the exhaust stream from the first turbine in a booster loaded recycle compressor to produce a compressed recycle stream at a recycle pressure between the first pressure and the second pressure, wherein the recycle compressor is disposed apart from the main feed compression system and the booster compression system and the compressed recycle stream is separate from the purified, compressed feed stream;

recycling the compressed recycle stream to the purified, compressed feed stream;

diverting a portion of the purified, compressed feed stream at the second pressure to a second turbine and expanding the diverted portion of the purified, compressed feed stream to a pressure at or above the first pressure and below the second pressure; and warming all of the exhaust stream from the second turbine in the primary heat exchanger and recycling all of the warmed exhaust stream from the second turbine to the purified, compressed feed stream;

wherein the shaft work of expansion from the second turbine drives one or more stages of compression in the booster loaded recycle compressor; and wherein the shaft work of expansion from the first turbine drives one or more stages of compression in the booster compression system.

2. The method of claim 1, wherein the cryogenic separation unit is a cryogenic air separation unit and the feed stream further comprises air or a stream comprised of one or more constituents of air.

3. The method of claim 1, wherein the pressure of the warmed exhaust stream from the second turbine is equal to the recycle pressure.

4. The method of claim 1, wherein the step of directing the first portion of the exhaust stream from the first turbine to the distillation column system of the cryogenic separation unit further comprises directing the first portion of the exhaust stream to a higher pressure column of the distillation column system.

5. The method of claim 1, further comprising the step of even further compressing the second portion of the still further compressed feed stream prior to the steps of cooling and condensing the second portion such that the second portion is liquefied at a pressure not less than the third pressure.

6. The method of claim 1, further comprising the steps of:

splitting the second portion of the still further compressed feed stream at the third pressure into a third high pressure portion and a fourth high pressure portion;

directing the third high pressure portion to the lower pressure column in the distillation column system; and directing the fourth high pressure portion to the higher pressure column in the distillation column system.

7. A cryogenic separation unit comprising:

a distillation column system with a lower pressure column and a higher pressure column, a multi-stage main feed compression system configured for compressing at least a portion of a feed stream to a first pressure;

a pre-purifier unit disposed downstream of the main feed compression system and configured for purifying the compressed feed stream to remove impurities;

a booster compression system disposed downstream of the pre-purifier unit and configured for further compressing the purified, compressed feed stream to a second pressure and then still further compressing a portion of the purified, compressed feed stream at the second pressure to a third pressure, wherein the third pressure is greater than the second pressure;

a primary heat exchanger configured to receive a first portion and a second portion of the still further compressed stream at the third pressure, partially cooling the first portion of the still further compressed stream at the third pressure, and condensing the second portion of the still further compressed stream at the third pressure to temperatures suitable for rectification in the lower pressure column of the distillation column system;

a first turbine arrangement configured to receive the partially cooled first portion of the still further compressed stream at the third pressure, expand such first portion to provide refrigeration, wherein a first portion of the expanded stream comprising between 30% and 50% of the expanded stream is directed to the higher pressure column and wherein another portion of the expanded stream comprising between 50% and 70% of the expanded stream is directed to the primary heat exchanger where it is warmed;

a recycle compression circuit configured to receive another portion of the expanded stream from the first turbine arrangement, warm said portion of the expanded stream in the primary heat exchanger, further compress the warmed expanded stream in a booster-loaded recycle compressor to produce a recycle stream at a recycle pressure between the first pressure and the second pressure, wherein the booster-loaded recycle compressor is disposed apart from the main feed compression system and the booster compression system and the compressed recycle stream is separate from the purified, compressed feed stream; wherein the compressed recycle stream is recycled to a location upstream of the boosted compression system;

a second turbine arrangement configured to receive a portion of the further compressed feed stream at the second pressure and expand such portion to provide refrigeration, wherein the expanded stream from the second turbine arrangement is warmed in the primary heat exchanger and recycled to a location upstream of the boosted compression system; and a warm turbine recycle circuit configured to receive all of the expanded stream from the second turbine arrangement, warm the expanded stream in the primary heat exchanger, and recycle all of the warmed expanded stream from the second turbine arrangement to a location upstream of the boosted compression system;

wherein the shaft work of expansion from the second turbine arrangement drives one or more stages of compression in the booster loaded recycle compressor; and wherein the shaft work of expansion from the first turbine drives one or more stages of compression in the booster compression system.

8. A method for providing refrigeration to a cryogenic separation unit, the cryogenic separation unit having a distillation column system with a lower pressure column and a higher pressure column, the method comprising the steps of:

compressing at least a portion of a feed stream in a multi-stage main feed compression system to a first pressure;

purifying the compressed feed stream to remove high boiling contaminants and other impurities;

further compressing at least a portion of the purified, compressed feed stream in a booster compression system to a second pressure;

still further compressing at least a portion of the further compressed feed stream at the second pressure in the booster compression system to a third pressure, wherein the third pressure is greater than the second pressure;

cooling a first portion of the still further compressed feed stream at the third pressure in a primary heat exchanger and expanding the cooled first portion of the feed stream at the third pressure in a first turbine to a pressure suitable for introduction into the higher pressure column;

wherein the first turbine is coupled to the booster compression system and the first turbine is configured such that the shaft work of expansion from the first turbine drives one or more stages of compression in the booster compression system;

cooling and condensing a second portion of the still further compressed feed stream at the third pressure and feeding the condensed second portion to the lower pressure column of the distillation column system;

directing a first portion of the exhaust stream from the first turbine to the higher pressure column of the distillation column system, wherein the first portion of the exhaust stream from the first turbine comprises between 30% and 50% of the exhaust stream from the first turbine;

warming a second portion of the exhaust stream from the first turbine which comprises between 50% and 70% of the exhaust stream from the first turbine and compressing the warmed second portion of the exhaust stream from the first turbine in a booster loaded recycle compressor to produce a compressed recycle stream at a recycle pressure between the first pressure and the second pressure, wherein the recycle compressor is disposed apart from the main feed compression system and the booster compression system and the compressed recycle stream is separate from the purified, compressed feed stream;

recycling the compressed recycle stream to the purified, compressed feed stream;

diverting a portion of the purified, compressed feed stream at the second pressure to a second turbine and expanding the diverted portion of the purified, compressed feed stream to a pressure at or above the first pressure and below the second pressure; and warming all of the exhaust stream from the second turbine in the primary heat exchanger and recycling all of the warmed exhaust stream from the second turbine to the purified, compressed feed stream;

wherein the shaft work of expansion from the second turbine drives one or more stages of compression in the booster loaded recycle compressor; and wherein the shaft work of expansion from the first turbine drives one or more stages of compression in the booster compression system.

* * * * *